US005476409A

United States Patent [19]

Wada et al.

[11] Patent Number: 5,476,409

[45] Date of Patent: Dec. 19, 1995

[54] GRINDING MACHINE

[75] Inventors: Tatsuya Wada; Kouichi Miyamoto; Takeshi Shiotani; Shoji Takahashi, all of Tokyo, Japan

[73] Assignee: Ryobi Limited, Hiroshima, Japan

[21] Appl. No.: 172,554

[22] Filed: Dec. 23, 1993

[30] Foreign Application Priority Data

Dec. 28, 1992 [JP] Japan ..... 4-349110

[51] Int. Cl.[6] ..... B24B 49/00

[52] U.S. Cl. ..... 451/12; 451/13; 451/23; 451/178; 451/296

[58] Field of Search ..... 451/11, 12, 13, 451/23, 177, 178, 179, 182, 296

[56] References Cited

U.S. PATENT DOCUMENTS

| | | | |
|---|---|---|---|
| 1,584,717 | 5/1926 | Belden et al. . | |
| 2,344,571 | 3/1944 | Turrettini . | |
| 2,444,010 | 6/1948 | Kasparson . | |
| 3,561,321 | 2/1971 | Belshaw et al. | 451/219 |
| 3,972,148 | 8/1976 | Beauchet et al. | 451/72 |
| 4,043,080 | 8/1977 | Maxwell | 451/123 |

FOREIGN PATENT DOCUMENTS

| | | |
|---|---|---|
| 3737636 | 5/1989 | Germany . |

*Primary Examiner*—Maurina T. Rachuba
*Attorney, Agent, or Firm*—Brooks & Kushman

[57] ABSTRACT

A grinding machine has a driving mechanism for rotating a drive shaft, a sander supported on the drive shaft, a bracket provided swingably on a housing for supporting the drive shaft, a drive shaft moving mechanism for moving the drive shaft in the axial direction, a hollow member supported on the bracket for ratably support the drive shaft, a drive shaft position switching mechanism for moving the hollow cylinder in its axial direction to take selectably two positions whereby the drive shaft can take smoothly two positions in one of which the drive shaft is not moved in its axial direction, and in the other of which the drive shaft is moved it its axial direction.

18 Claims, 21 Drawing Sheets

GRINDING MACHINE

BACKGROUND OF THE INVENTION

This invention relates to a grinding machine, and more particularly, to a grinding machine in which a sander (grinding wheel) can be controlled so as to be restricted in its oscillatory movement.

In general, a well known grinding machine has a sander against which a work abuts while the sander is rotated and moved reciprocatingly in its axial direction during a grinding or polishing.

However, there is a case that an operation is desirably performed while the sander is not moved in its axial direction. U.S. Pat. No. 1,849,868 discloses an oscillator for restricting the reciprocal movement of the sander in the axial direction. The oscillator has a cam groove at the circumferential surface of a driving shaft, and a ring member having a cam which is engaged with the cam groove is provided slidably on the outer periphery of the driving shaft. A cover for the ring member restricts the sliding movement of the ring member on the driving shaft. When the driving shaft is moved reciprocatingly in the axial direction, the ring member is covered with the cover so as to be restrained from sliding on the driving shaft. With this state, when the driving shaft is rotated, the driving shaft is reciprocatingly moved along the cam groove. In contrast, when the driving shaft is restrained from moving reciprocatingly, the cover is eliminated. With this state, the ring member is slit in the axial direction because of the engagement of the cam with the cam groove in a state wherein the driving shaft is not moved in the axial direction.

However, in the above conventional structure, even in case that the driving shaft is restrained from moving in the axial direction, the cam is engaged with the cam groove thereby to generate sound of friction. Further, a switching operation between an operation for restricting the movement of the driving shaft in its axial direction and an operation for moving the driving shaft in its axial direction is troublesome because the cover must be put on or taken off.

SUMMARY OF THE INVENTION

It is an object of this invention to provide a grinding machine in which sound of friction is not generated in the case of the restraint of the driving shaft in its axial direction and a switching operation between an operation for restricting the movement of the driving shaft and an operation for moving the driving shaft in its axial direction is performed easily.

According to this invention, there is provided a grinding machine which includes: a driving mechanism for rotating a drive shaft, a sander provided on the drive shaft for grinding a work piece, a drive shaft moving mechanism for moving the drive shaft in its axial direction during a grinding operation, a drive shaft support member for supporting rotatably the drive shaft, and a drive shaft position switching mechanism for moving the drive shaft support member in axial direction of the drive shaft to take selectably two positions in one of which the drive shaft moving mechanism is operated and in the other of which the drive shaft moving mechanism is not operated.

Other objects and advantageous effects will be more clearly described with reference to the following drawings.

DETAILED DESCRIPTION OF THE INVENTION

Figure 1:
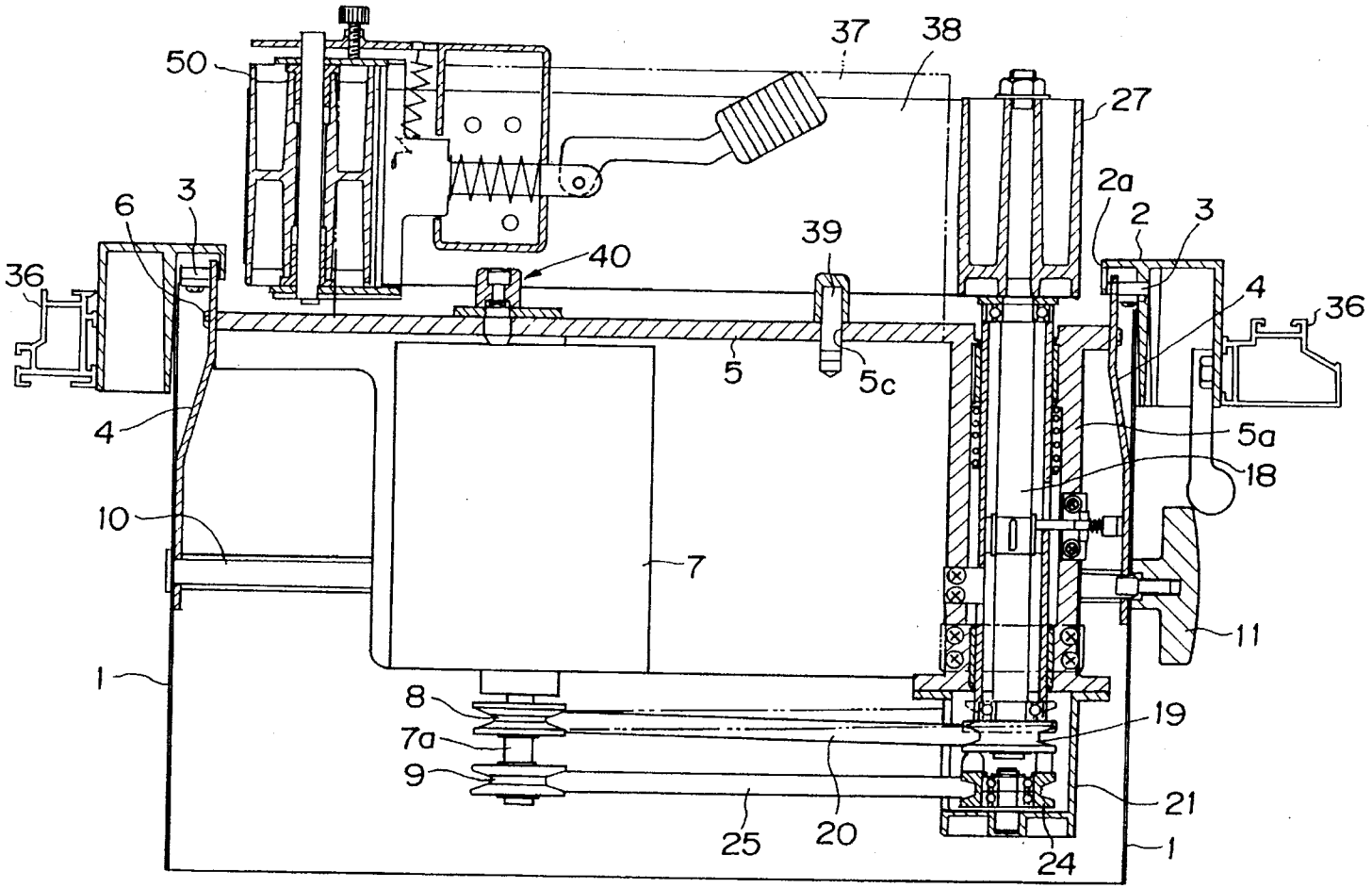
FIG. 1 is a frontal cross sectional view of a grinding machine according to this invention.

In FIG. 1, a housing 1 has a table 2 at its upper part. The table 2 is provided with an opening 2*a*, on the opposite sides (left and right sides in FIG. 1) of which two support plates 4, 4 are swingably provided about two pivot pins 3, 3, respectively. A bracket 5 is swingably supported between the support plates 4,4 via screws 6,6, and a motor 7 is fixed to the bracket 5. The motor 7 has a motor shaft 7*a* to which two pulleys 8, 9 are fixed. Furthermore, the support plates 4,4 support a handle shaft 10 therebetween which passes through an arched guide path la (FIG. 2) formed on the housing 1. The handle shaft 10 has a screw-engaged handle 11 at its left end as viewed in FIG. 1. When the handle 11 is fastened to the housing 1, the swinging motion of the support plates 4,4 is restricted. On the right side as viewed in FIG. 1 is a recess 5*a* which extends vertically long and has a semi-circular shape in cross section (see FIG. 7).

Figure 3:
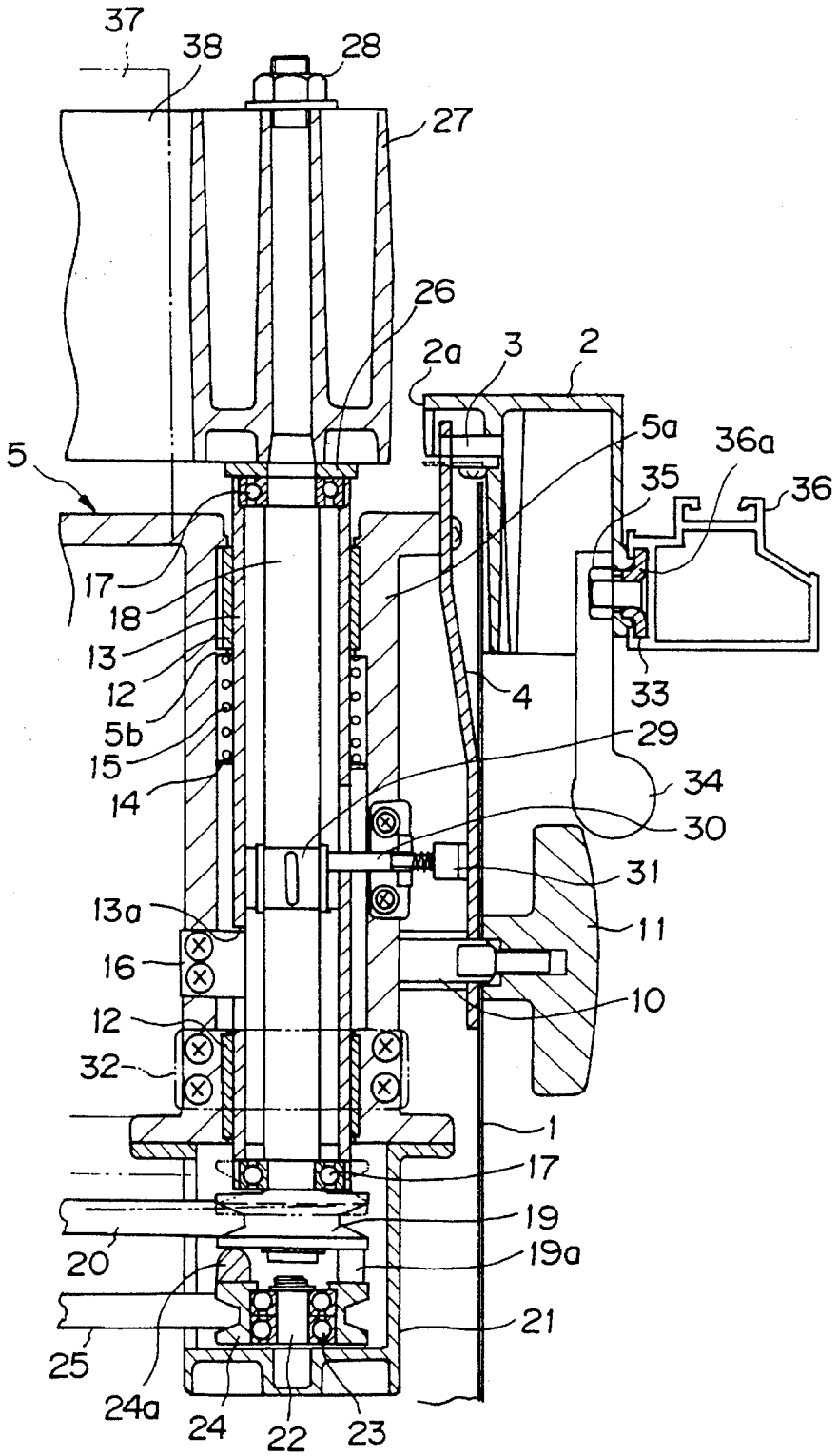
FIG. 3 is a partial enlarged sectional view showing a recess of the grinding machine according to this invention.

In FIG. 3, the recess 5*a* receives a hollow member 13 as a drive shaft support member via two bearings 12, 12. The hollow member 13 is movable vertically, and has a ring member 14 at its circumferential predetermined position.

The ring member 14 and a flange portion 5*b* formed on the inner surface of the recess 5*a* hold a coil spring 15 for urging the cylindrical member 13 downwardly as viewed in FIG. 3. The cylindrical or hollow member 13 has, at its lower portion, a longitudinal aperture 13*a* with which a lock plate 16 fixed to the bracket 5 is engaged to restrict the rotation of the hollow member 13. The hollow member 13 has, at its upper and lower ends, two bearings 17, 17, respectively, to support a driving shaft 18 rotatably. The driving shaft 18 holds, at its lower end, a pulley 19 around which one end portion of a belt 20 is wound, and the other end portion of the belt 20 is wound around the pulley 8 fixed to the motor shaft 7*a* (FIG. 1). Also in FIG. 3, a holding frame 21 is mounted on the lower end of the recess 5*a* to hold a pulley 24 which is rotatably supported by a shaft 22 via a bearing 23. A belt 25 is provided between the pulley 24 and the pulley 9 on the motor shaft 7*a*. It should be noted that an outer diameter of the pulley 19 is somewhat different from that of the pulley 24. A cam 24*a* is formed on the pulley 24 toward the pulley 19. A contact portion 19*a* which is to come into contact with the cam 24*a* is formed on the pulley 19. In this case, due to the fact that the outer diameters of the pulleys 19, 24 differ from each other, the contact position between the contact portion 19*a* and the cam 24*a* is changed in accordance with the rotation of the pulleys 19 and 24, so that the pulley 19 and hence the drive shaft 18 are reciprocated up and down in FIG. 3. That is, there is a phase difference in rotation of the two pulleys 19, 24 so that the contact portion 9*a* slides along the cam 24. The pulleys 19, 24, the cam 24, the contact portion 19*a*, etc., have a drive shaft moving mechanism for moving the drive shaft 18 in its axial direction, respectively. On the other hand, a drive roller 27 is engaged with an upper portion of the drive shaft 18 through a cotton felt washer 26 and is fastened thereto by a nut 28. Also, a locking ring 29 is fixed to the intermediate portion of the drive shaft 18, and a locking pin 30 which is engageable with the locking ring 29 is provided movably in both right and left directions in the recess portion 5*a*. A button 31 is coupled to the locking pin 30 so that, by the ON/OFF operation of the button 31, the locking pin 30 may be engaged with or disengaged from the locking ring 29. By engaging the locking pin 30 with the locking ring 29, the rotation of the drive shaft 18 is restricted. Also, a bearing cover 32 is provided at the lower portion of the recess portion 5*a* to cover the bearing 12.

On the other hand, an engaging member 33 is provide outside of the table 2, and a screw portion (not shown) of the engaging member 33 penetrates the side plate of the table 2 to screw engaged with the nut 35 embedded in a fastening handle 34. The engaging member 33 is engaged with a groove 36*a* formed in a rail 36 extending in the front and rear direction. When the fastening handle 34 is fastened, the rail 36 is fixed to the side surface of the table 2. As shown in FIG. 1, a rail 36 is also provided on the left side of the grinding machine.

A base 37 is detachably mounted on the top surface of the bracket 5. The base 37 is used for the purpose of guiding the movement of an endless belt dander 38 and for preventing an insufficient polishing work due to a flexibility or warpage of the belt sander when a workpiece (not shown) is pressed against the belt sander 38. A base positioning pin 39 is provided on the base 37 and an insertion hole 5*c* into which the pin 39 may be inserted is formed at a predetermined position of the bracket 5. The base 37 is fixed to the bracket 5 by a base fastening mechanism 40.

Figure 4:
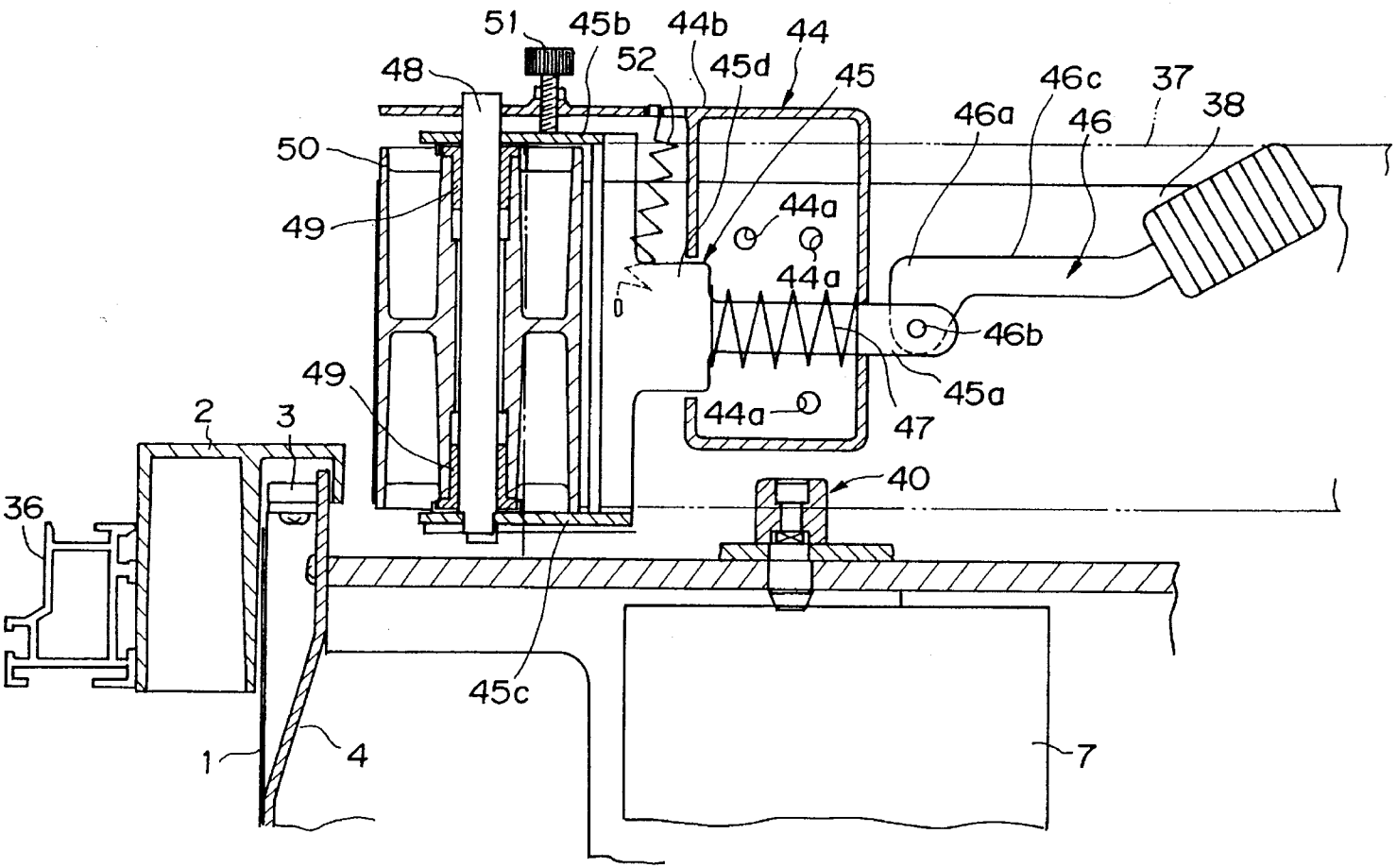
FIG. 4 is a partial enlarged sectional view showing the vicinity of a driven roller of the grinding machine according to this invention.

FIG. 4 is an enlarged view showing a left right portion of FIG. 1. A roller bracket 44 is fastened to the base 37 by screws (not shown). Reference character 44*a* denotes screw holes for the screws. A holder 45 for holding a driven roller 50 is provided movably in the right and left directions in the roller bracket 44. A pivot portion 46*b* which is formed at an end portion of a lever 46 is pivotally supported at a right end portion (FIG. 4) of the holder 45. The lever 46 is rotatably mounted about the pivot portion 46*b*. A spring 47 is interposed between the holder 45 and the right side plate (FIG. 4) of the roller bracket 44 while being wounded around a projected portion 45*a* of the holder 45. Thus, the holder 45 is biased in the left direction in the drawing by the spring 47. Furthermore, an upper plate portion 45*b* and a bottom plate portion 45*c* are formed in the left portion, in the drawing, of the holder 45, and a shaft 48 is fixed between the upper plate portion 45*b* and the bottom plate portion 45*c*. The driven roller 50 is rotatably provided on the shaft 48 through a pair of bearings 49. A roller slanting screw 51 is threadedly engaged with an upper plate portion 44*b* of the roller bracket 44 and is in contact with the upper plate portion 45*b* of the holder 45. It should be noted that the axial position of the roller slanting screw 51 is displaces from the axial position of the above-described shaft 48. This is because the driven roller 50 provided on the shaft 48 may be slanted by the adjustment of the roller slanting screw 51. Furthermore, a spring 52 is interposed between a body portion 45*d* of the holder 45 and the upper plate portion 44*b* of the roller bracket 44 so that the holder 45 is biased upwardly whereby the upper plate portion 45*b* of the holder 45 comes into contact with a tip end of the roller slanting screw 51. The belt sander 38 is wound around the driven roller 50 thus provided and the drive roller 27 shown in FIG. 1.

Figure 6:
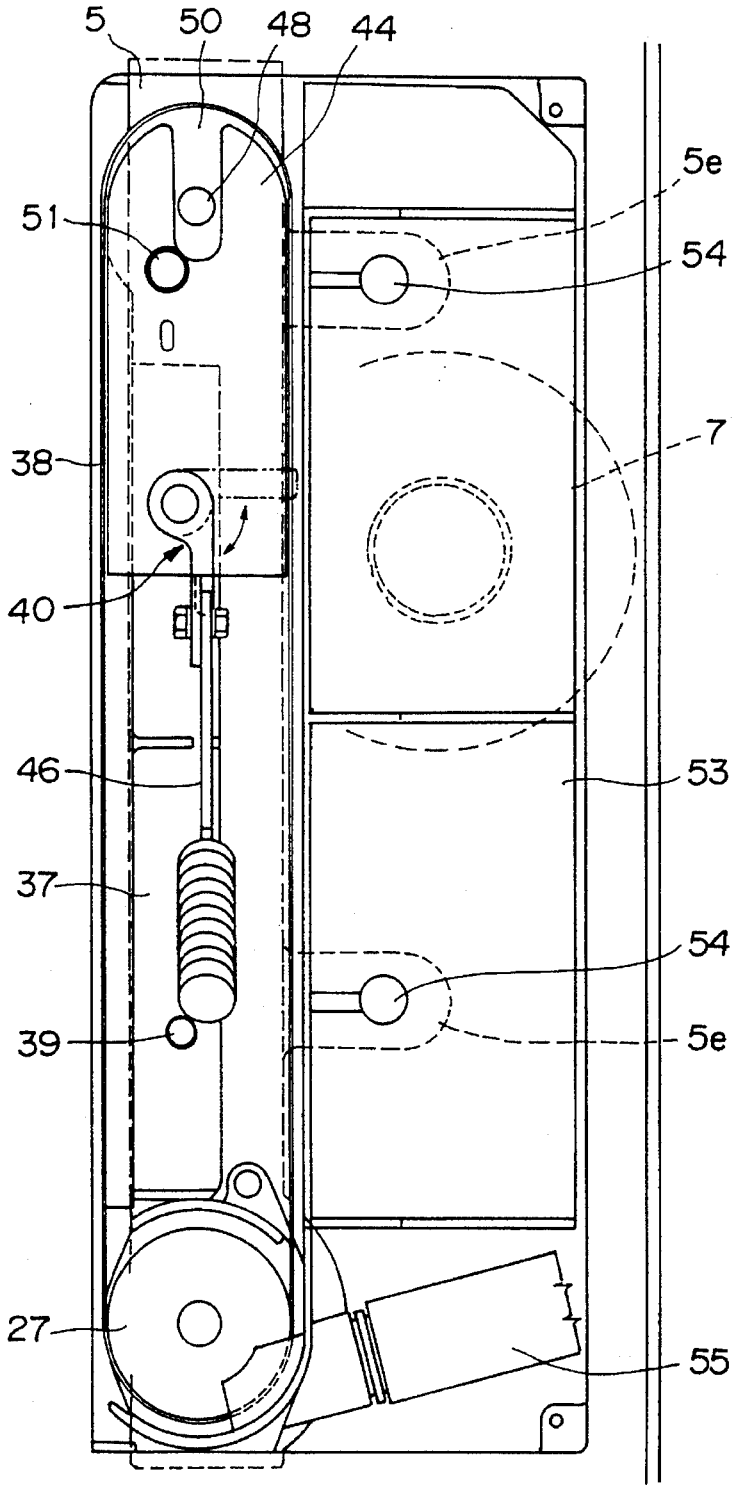
FIG. 6 is a partial plan view of the grinding machine according to this invention.

FIG. 6 is a partial plan view showing a part of the grinding machine according to the invention. A pair of projections 5*e*, 5*e* are formed in the bracket 5 in the right part of FIG. 6. A belt cover 53 is laid above the pair of projections 5*e*, 5*e* and is fixed by a pair of pins 54, 54. The belt cover 53 is used to cover a back side (i.e., right part in FIG. 10) of the belt sander 38 and may readily be detached away from the bracket 5 by the pin 54, 54. A connector tube 55 connected to a dust collector (not shown) is provided in the vicinity of the drive roller 27 for collecting powders or chips.

On the other hand, turning back to FIG. 2, a guide plate fastening screw 56 is mounted on the table 2, and guide plate 57 is provided on the guide plate fastening screw 56 for guiding the workpiece. The guide plate 57 is rotatable about the centerline of the guide plate fastening screw 56 for adjusting a contact angle of the workpiece relative to the belt sander 38 and the like. Also, the guide plate 57 is positionally adjustable in the left and right directions in FIG. 2. A drive shaft position switching mechanism 58 for switching the position of the drive shaft 18 in its axial direction is provided in the middle of the hollow member 13.

Figure 7:
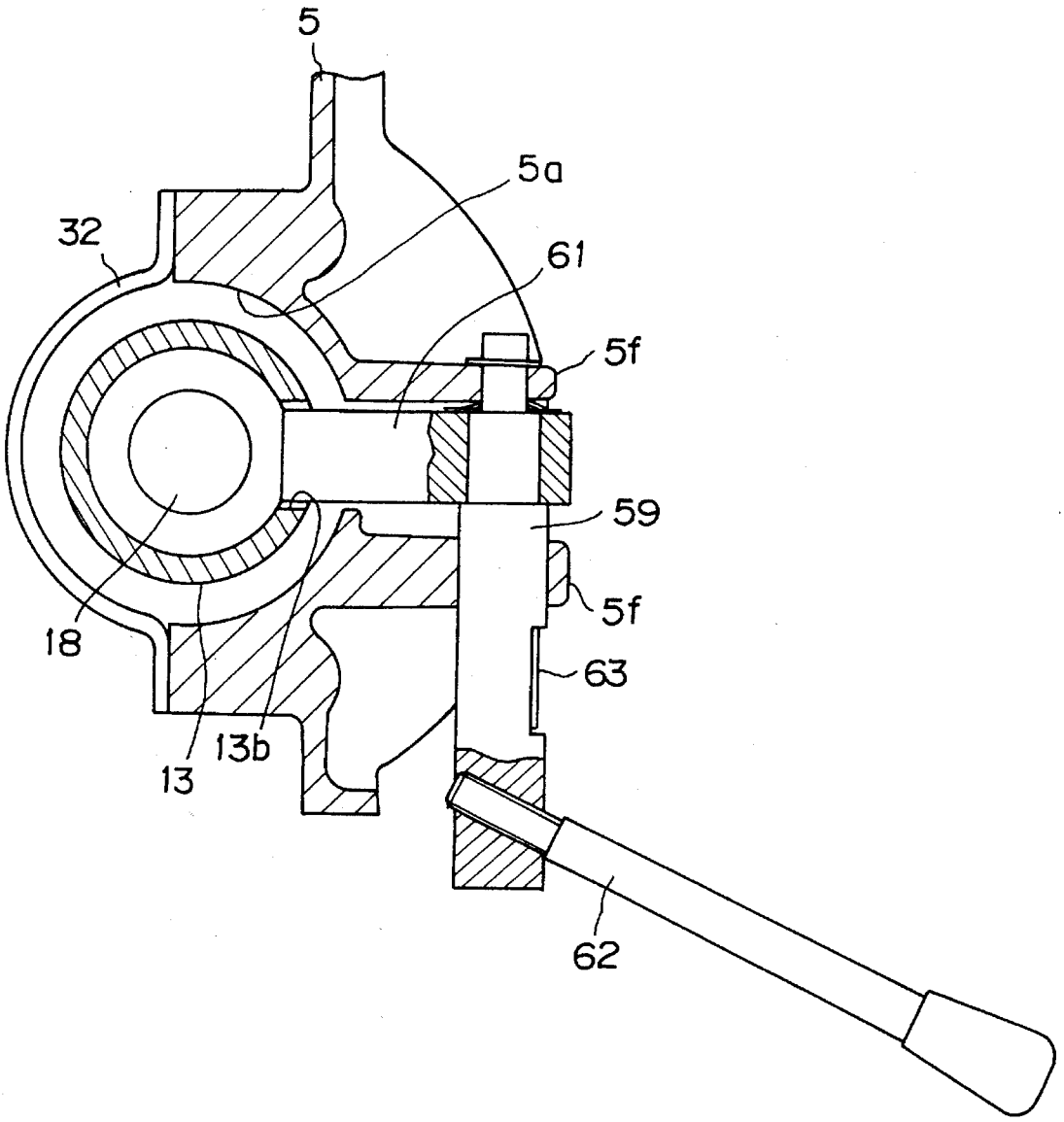
FIG. 7 is a plane or cross sectional view showing a drive shaft position mechanism.
Figure 8A:
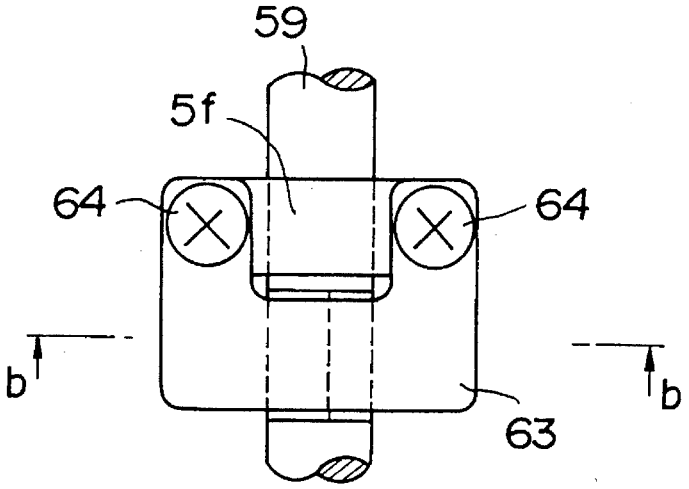
FIGS. 8A and 8B are explanatory drive shaft views of a part of the position switching mechanism, respectively.
Figure 8B:
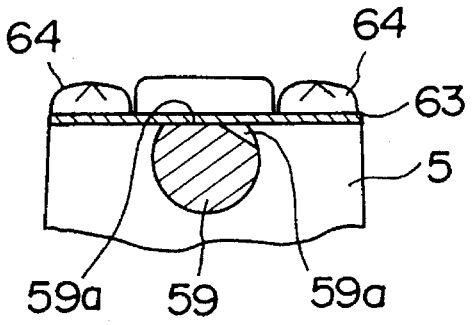

FIG. 7 to 9 show the drive shaft position switching mechanism 58. In FIG. 7, a pair of projections 5*f*, 5*f* provided on the bracket 5 and a rotary shaft 59 is rotatably supported to the projections 5*f*, 5*f*. A hook 61 is fixed to one side of the rotary shaft 59 so that the hook 61 may rotate together with the rotary shaft 59 by a pair of keys 60, 60 (see FIG. 9). A hole 13*b* formed in the hollow member 13 is engaged with the tip end portion of the hook 61. Furthermore, a handle 62 is thread-engaged with the other end portion of the rotary shaft and the latter may be rotated by the operation of the handle 62. Moreover, in FIG. 2, the handle 62 is projected outside the guide path l*b* formed in the housing 1 for easy operation. On the other hand, in FIG. 8, a resilient plate member 63 is fixed to the projections 5*f*, 5*f* of the bracket 5 by screw 64, 64. The resilient member 63 is biased centrally downwardly of FIG. 8B and is depressed against one of a pair of flat portions 59*a*, 59 formed in the rotary shaft 59. Thus, the resilient member 63 is depressed against one of the pair of flat portions 59*a*, 59*a* to thereby restrict the rotation of the rotary shaft 59 to two switching positions. The handle 62, the rotary shaft 59, etc., forms a hook rotating mechanism.

Figure 2:
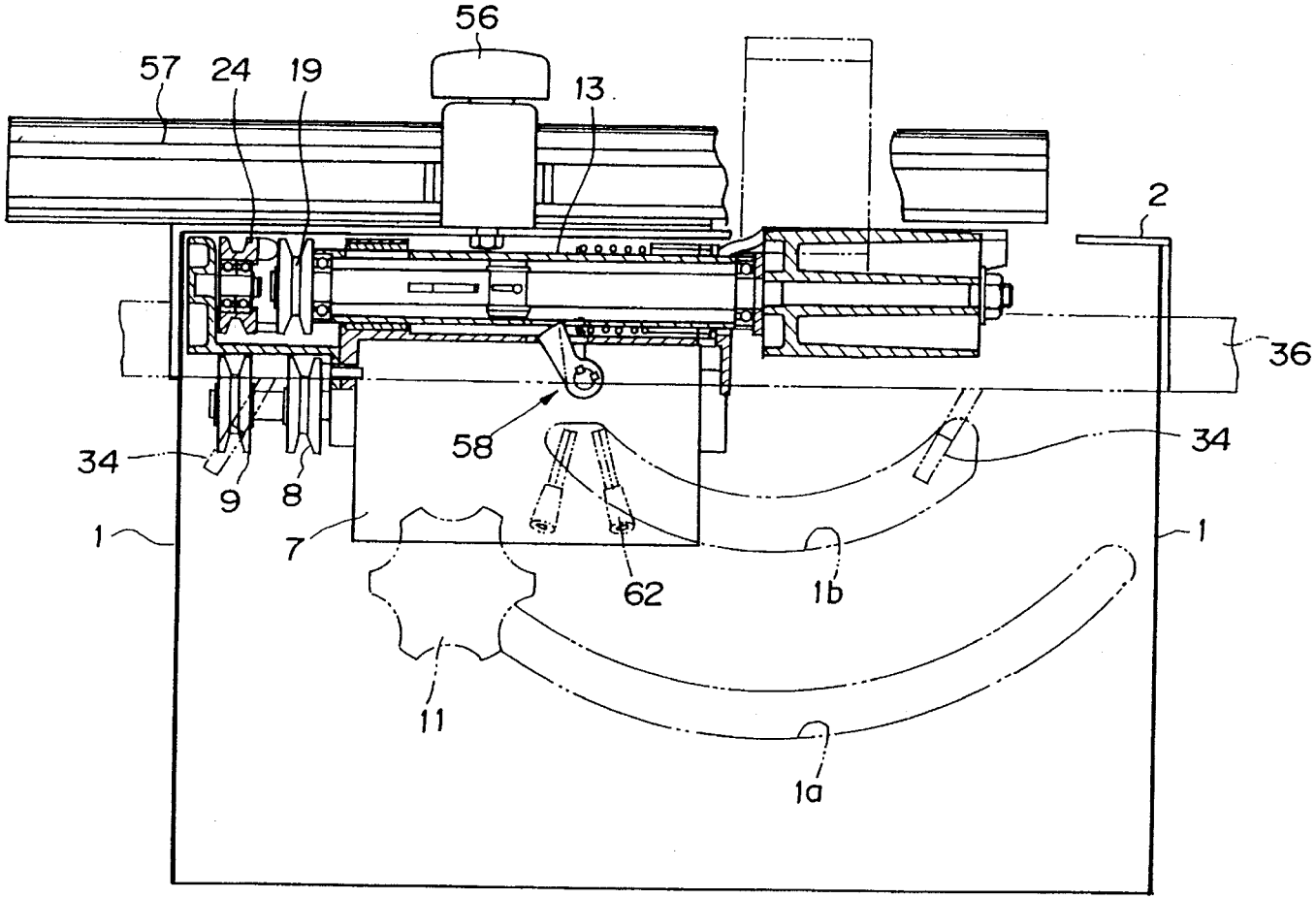
FIG. 2 is a side cross sectional view of the grinding machine according to this invention.
Figure 5:
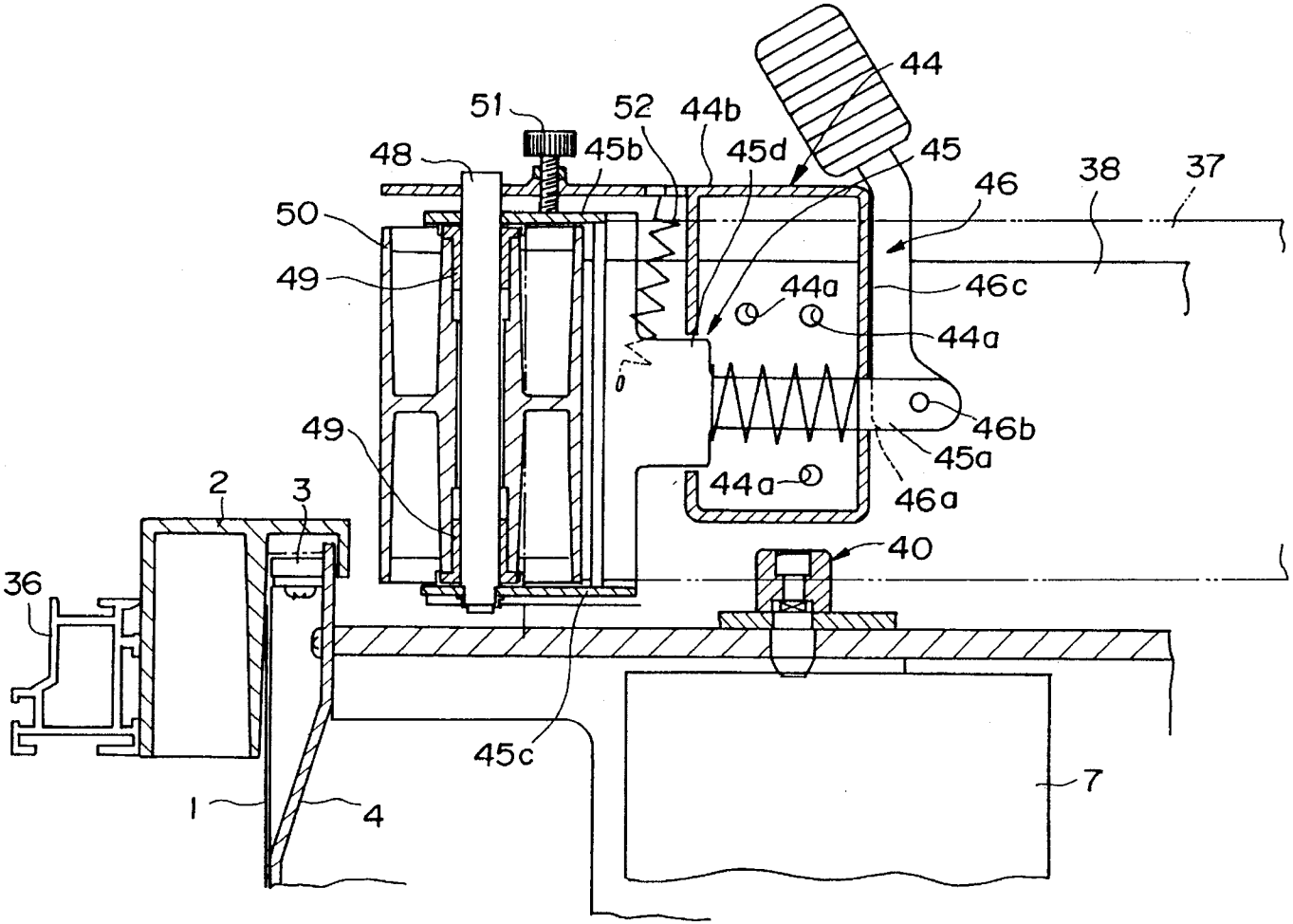
FIG. 5 is a partial enlarged sectional view showing an operation of a lever for the driven roller of the grinding machine according to this invention.
Figure 10:
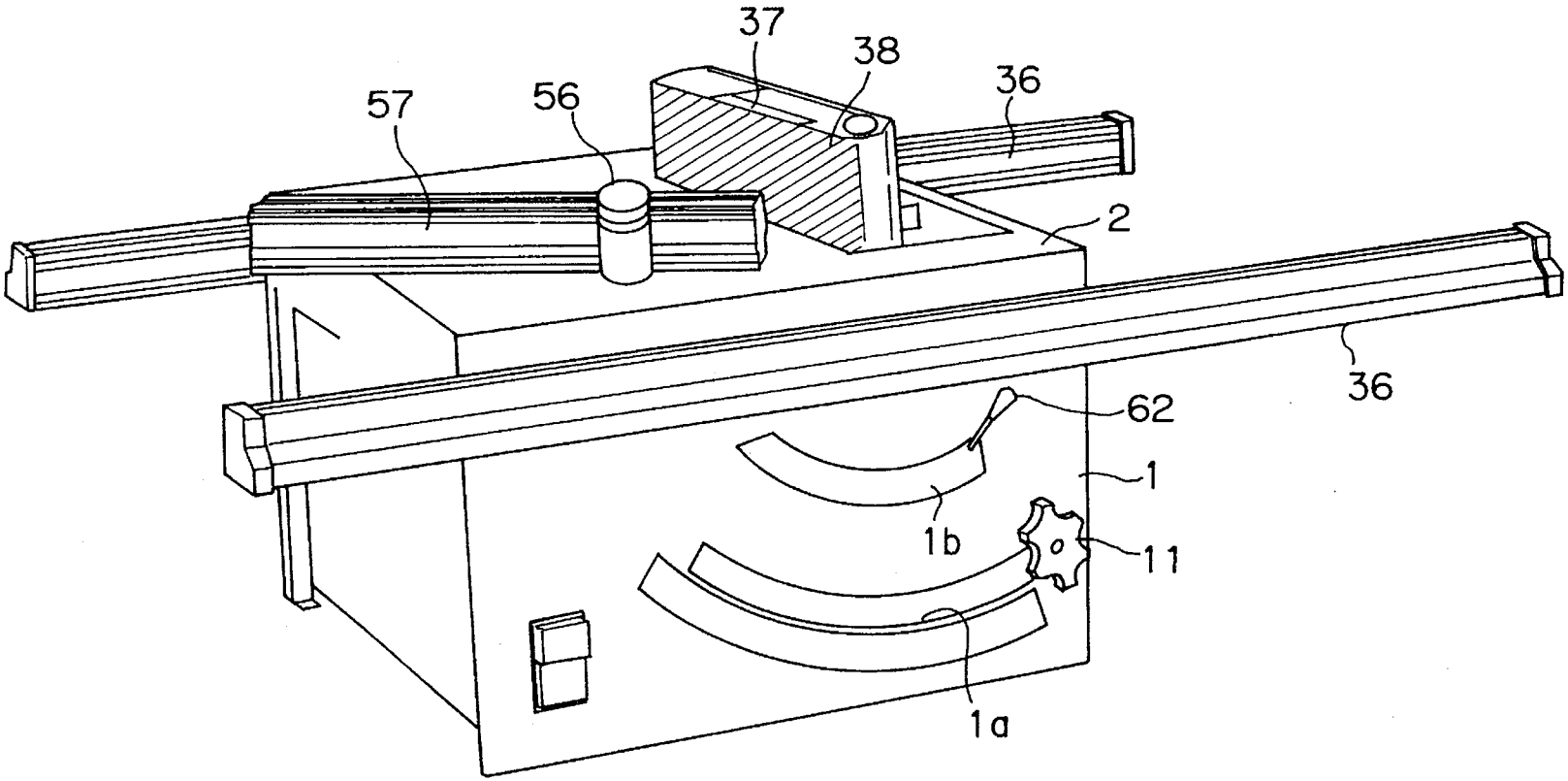
FIG. 10 is a perspective view of the grinding machine according to this invention in a state where a belt sander is set vertically.

The operation of the thus constructed grinding machine will be explained. Explanation will be made as to the case where the belt sander 38 is used in the upright position (vertically) as shown in FIG. 10. In FIG. 2, the handle 11 is loosened, moved along the guide path la, and positioned at a desired position and fastened thereat. In FIG. 3, the holder plate 4 is also rotated about the rotary pin 3 through the handle shaft 10 mounted on the handle 11 and the bracket 5 is also rotated. The handle 11, the holder plates 4,4, etc., form a bracket locating mechanism for locating the bracket at a desired swinging position. Thus, the drive roller 27 and the driven roller 50 (FIG. 1) are in the upright position. Thereafter, the base 37 provided with the roller bracket 44 is fixed to the bracket 5. In FIG, 1, the pin 39 fixed to the base 37 is inserted into the insertion hole 5*c* of the bracket 5, and the base 37 is fixed to the bracket 5 by the base fastening mechanism 40. Thereafter, as shown in FIG. 5, the lever 46 takes an upright position so that the side face 46*c* of the lever 46 abuts against the right side surface, as viewed in FIG. 5, of the roller bracket 44 in order to set the belt sander 38 between the drive roller 27 and the driven roller 50 (see FIG. 1). Then, the lever 46 is rotated in the clock-wise direction about the pivot point 46*b* as shown in FIG. 4. Then, the tip end 46*b* of the lever is rotated in sliding contact with the right surface of the roller bracket 44. As this time, the holder 45 is moved in the left direction in FIG. 5, and hence the driven roller 50 is moved in the left direction in FIG. 4, thereby tensioning the belt sander 38.

Furthermore, after the tensioning action of the belt sander 38, in FIG. 6, the belt cover 53 is fixed to the bracket 5 by the pins 54, 54. Thereafter, in FIG. 1, the motor 7 is driven to rotate the pulleys 8,9 through the motor shaft 7*a*. In accordance with the rotation of the pulleys 8, 9, the pulleys 19, 24 are rotated through the belts 20, 25. The motor 7, pulleys 8, 9, 19 and the belt 20 form a driving mechanism for rotating the drive shaft 18. In accordance with the rotation of the pulley 19, the drive shaft 18 is also rotated, and hence the drive roller 27 is also rotated. The rotation of the drive roller 27 causes the belt sander 38 to move between the drive roller 27 and the driven roller 50. On the other hand, due to the fact that the outer diameter of the pulley 19 is somewhat different from that of the pulley 24, the rotational speed (rpm) of the former is somewhat different from that of the latter. Therefore, in FIG. 3, the contact position between the contact portion 19*a* of the pulley 19 and the cam 24*a* of the pulley 24 is varied in accordance with the rotation of the pulleys 19, 24 so that the pulley 19 is moved up and down (in FIG. 3). In accordance with this movement, the drive roller 27 is also moved up and down through the drive shaft 18. As a result, one side of the belt sander 38 is moved up and down to thereby enhance the polishing or grinding action. Under this condition, the workpiece (not shown) is brought into contact with the belt sander 38 by the guidance of the guide plate 57 (see FIG. 2) to thereby perform the polishing action with the belt sander 38.

Also, in accordance with the up-and-down movement of the drive roller 27, the hollow member 13 is also moved up and down. Accordingly, by limiting the up-and-down movement of the hollow member 13, it is possible to limit the up-and-down movement of the drive roller 27.

The case where the up-and-down movement of the drive roller 27 is not desired will be explained.

Figure 9A:
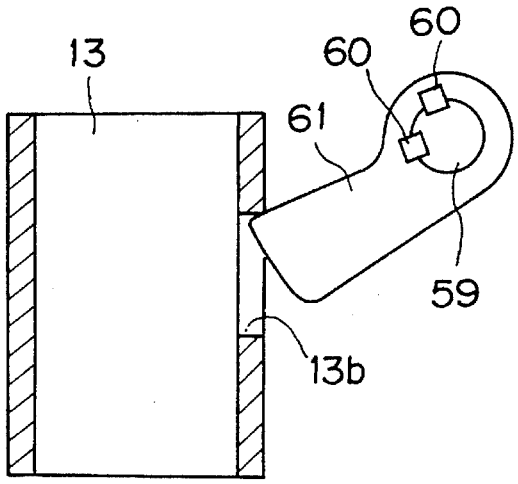
FIGS. 9A and 9B are explanatory drive shaft views of a part of the position switching mechanism, respectively.
Figure 9B:
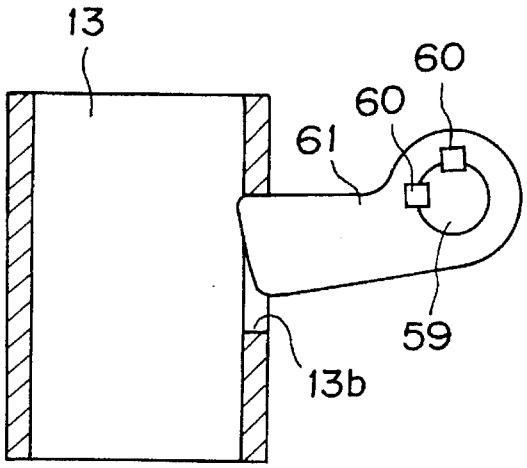

FIG. 9A shows the state where the hollow member 13 may be moved up and down. Namely, in this case, the hollow member 13 may be moved upwardly. In this state, in FIG. 7, the handle 62 is operated so that the rotary shaft 59 is rotated. In accordance with the rotation of the rotary shaft 59, the hook 61 is rotated in the clockwise direction in FIGS. 9A and 9B. As shown in FIG. 9B, since the hook 61 is engaged with the hole 13*b*, the hollow member 13 is moved upwardly. In accordance with the upward movement of the hollow member 13, in FIG. 3, the drive shaft 18 with the drive roller 27 is moved upwardly. As a result, the contact portion 19*a* of the pulley 19 is separated away from the cam 24*a* of the pulley 24. Accordingly, even if the pulleys 19, 24 rotate, the pulley 19 will not be moved up and down in FIG. 3 and hence the drive roller 27 will not be moved up and down. In this case, since the contact portion 19*a* and the cam 24*a* are separated from each other, a friction noise due to the contact between the contact portion 19*a* and the cam 24*a* will not be generated. The operation is noiseless.

Figure 11:
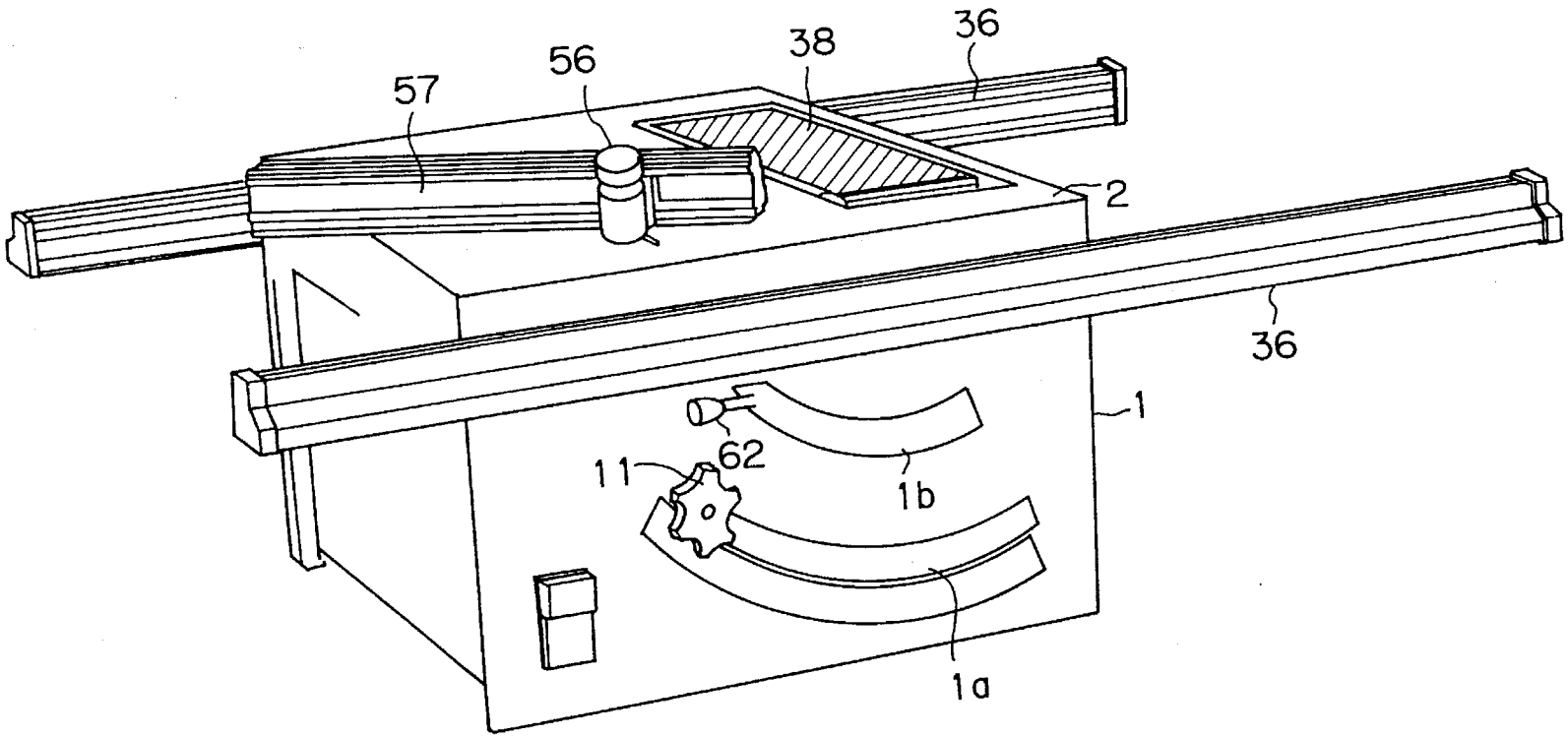
FIG. 11 is a perspective view of the grinding machine according to this invention in a state where the belt sander is set horizontally.

Also, in FIG. 2, by operating the handle 11 and causing the bracket 5 (see FIG. 1) to slant as desired, it is possible to keep the working surface of the belt sander 38 in parallel with the surface of the table 2 as shown in FIG. 11. This position is suitable particularly for polishing the planar surface of the workpiece.

Figure 12:
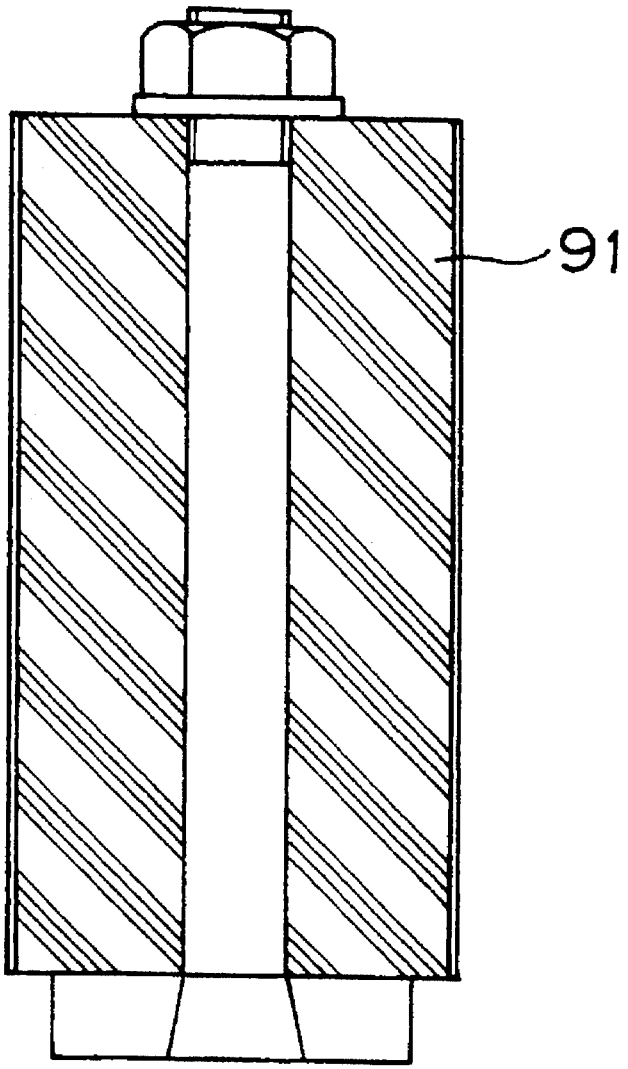
FIG. 12 is a longitudinal sectional view of a spindle sander of the grinding machine according to this invention.
Figure 13:
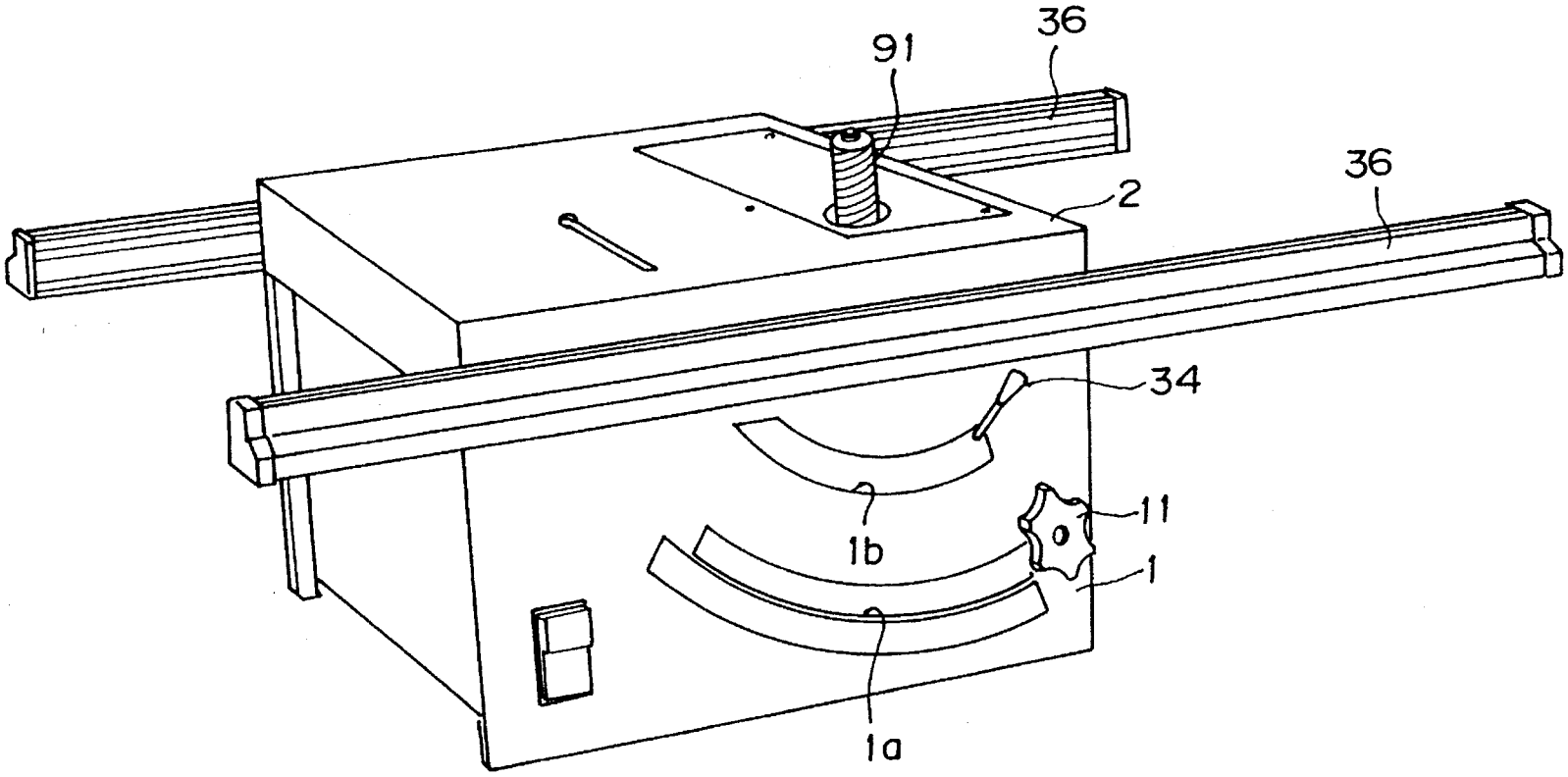
FIG. 13 is a perspective view of the grinding machine according to this invention in a state where a spindle sander is used.

Furthermore, in the case a spindle sander 91 as shown in FIG. 12 is used for polishing, the above-described belt cover 53 and belt sander 38 (see FIG. 6) are removed in the opposite order to the above-described order. Furthermore, in FIG. 3, the nut 28 is removed and the drive roller 27 is removed from the drive shaft 18. Thereafter, the spindle sander 91 is inserted into the drive shaft 18 and is fastened thereto by the nut 28 (FIG. 13). Under this condition, the motor 7 (see FIG. 1) is driven so that the spindle sander 91 is rotated and moved up and down in the same way as in the case of the belt sander 38. Incidentally, in the case where the vertical movement of the spindle sander 91 is not desired, the vertical movement of the hollow member 13 is restricted by the above-described drive shaft position switching mechanism 58 (see FIG. 2 and FIGS. 11 to 13B) and hence the vertical movement of the spindle sander 91 may be restricted.

Thus, in the grinding machine according to the present invention, it is possible to use either belt sander 38 and spindle sander 91 as desired, thereby imparting a versatility of the grinding machine.

Another embodiment of a drive shaft position switching mechanism according to this invention will now be explained with reference to FIGS. 14 to 18.

Figure 15:
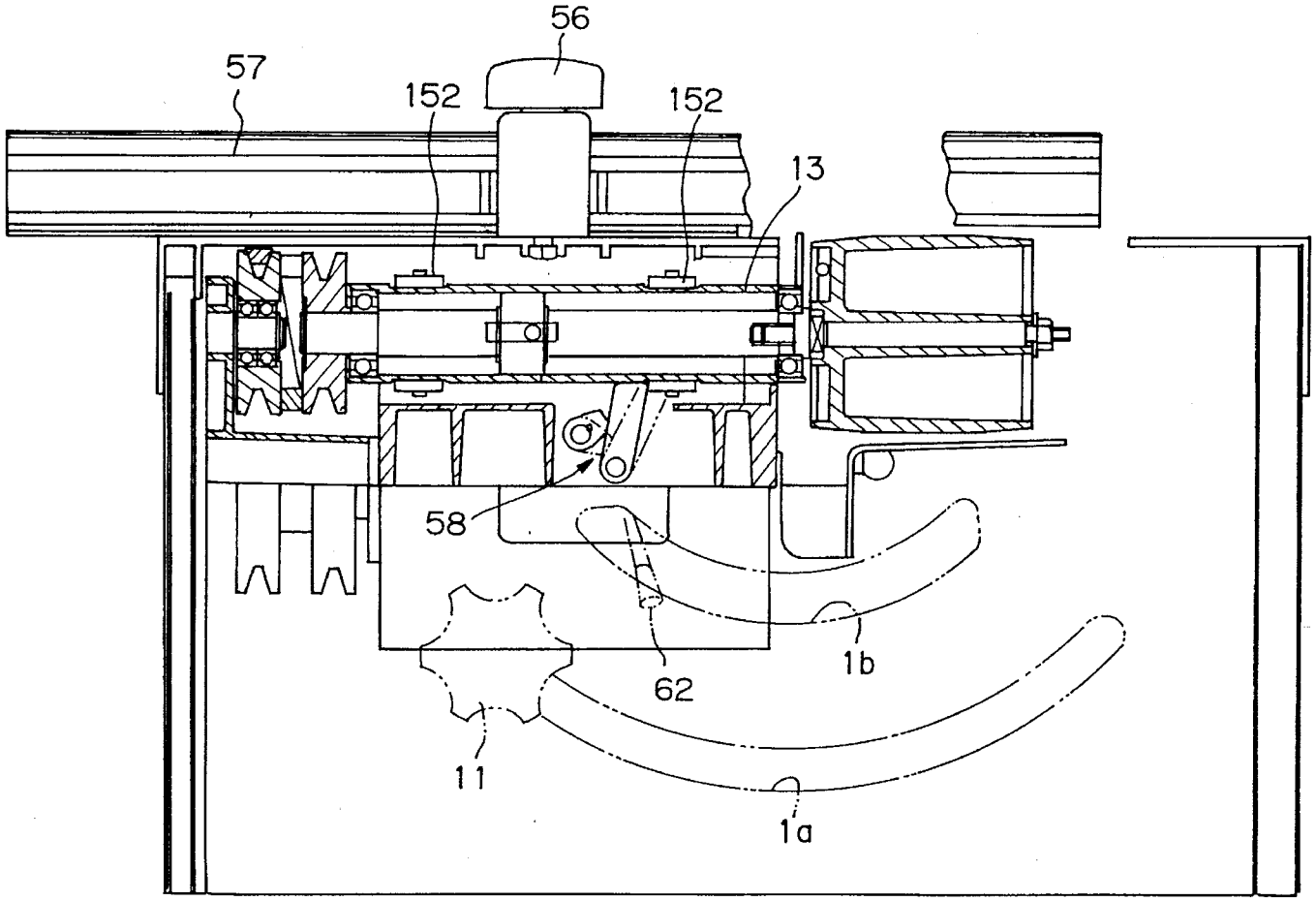
FIG. 15 is a side sectional view of the grinding machine in FIG. 14.
Figure 16:
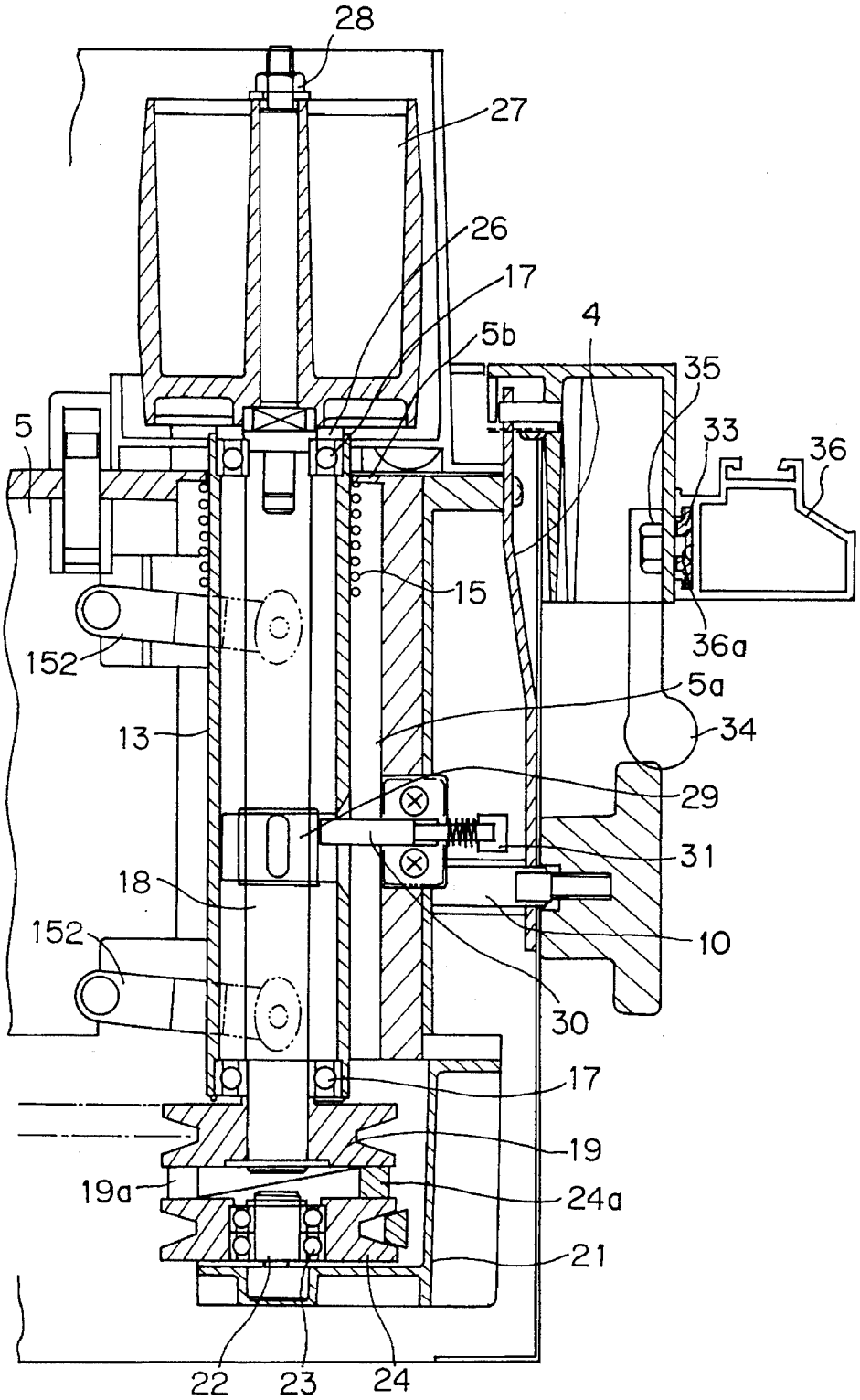
FIG. 16 is an enlarged sectional view showing the vicinity of the recess of the grinding machine.
Figure 17:
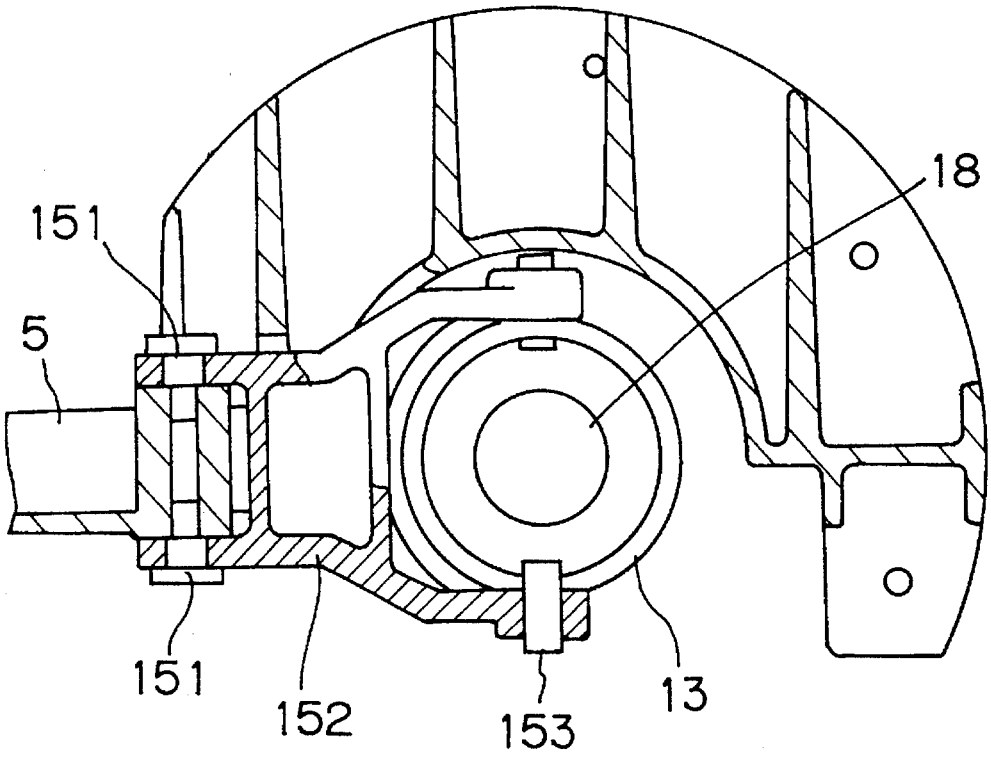
FIG. 17 is a partial plane sectional view of a part of the drive shaft position switching mechanism.

In FIG. 16, the hollow member 13 is provided movably vertically inside of the recess 5*a*. The hollow member 13 is pivotably connected to a pair of links 152 each of which is swingably provided on the bracket 5 via a pin 151 as shown in FIG. 17. The link 152 has a shape of ladder as viewed form above, and two expanded arms between which the hollow member 13 is supported. A coil spring 15 is provided, around the outer periphery of the hollow member 13, between a flange portion 5b formed at inner periphery of the recess 5a and the link 152 to urge the hollow member 13 downwardly as viewed in FIG. 16. The drive shaft position switching mechanism 258 has a nail member 154 provided rotatably on a pin 155 supported on the bracket 5. In the vicinity of the pin 155, a shaft 156 is rotatably provided on the bracket 5. The shaft 156 holds a cam 157. The coil portion of a spring 158 is wound around the pin 155. One arm of the spring 158 is engaged with the nail member 154, and the other arm thereof is engaged with the shaft 156 to urge normally the nail member 154 in the counterclockwise direction in FIG. 18. Further, the spring 158 urges the nail member 154 toward the cam 157. At the end of the shaft 156 is screw-engaged the handle 62 which is movable along the guide path 1b of the housing 1 (FIG. 15). The shaft 156 is rotated by the operation of the handle 62.

The operation of the grinding machine thus constructed will now be explained.

First, an explanation will be directed to a case that the belt sander 38 is used in an upright state as shown in FIG. 10.

In FIG. 15, the handle is loosened to be moved along the guide path 1a, to be located in position and to be fastened there.

The movement of the handle 11 along the guide path 1a rotates the support plates 4, 4 about the rotary pin 3 via the handle shaft to thereby to rotate the bracket 5. Thus, the belt sander 38 is set in an upright state. Thereafter, the base 37 with the bracket 44 is fixed to the bracket 15.

Figure 14:
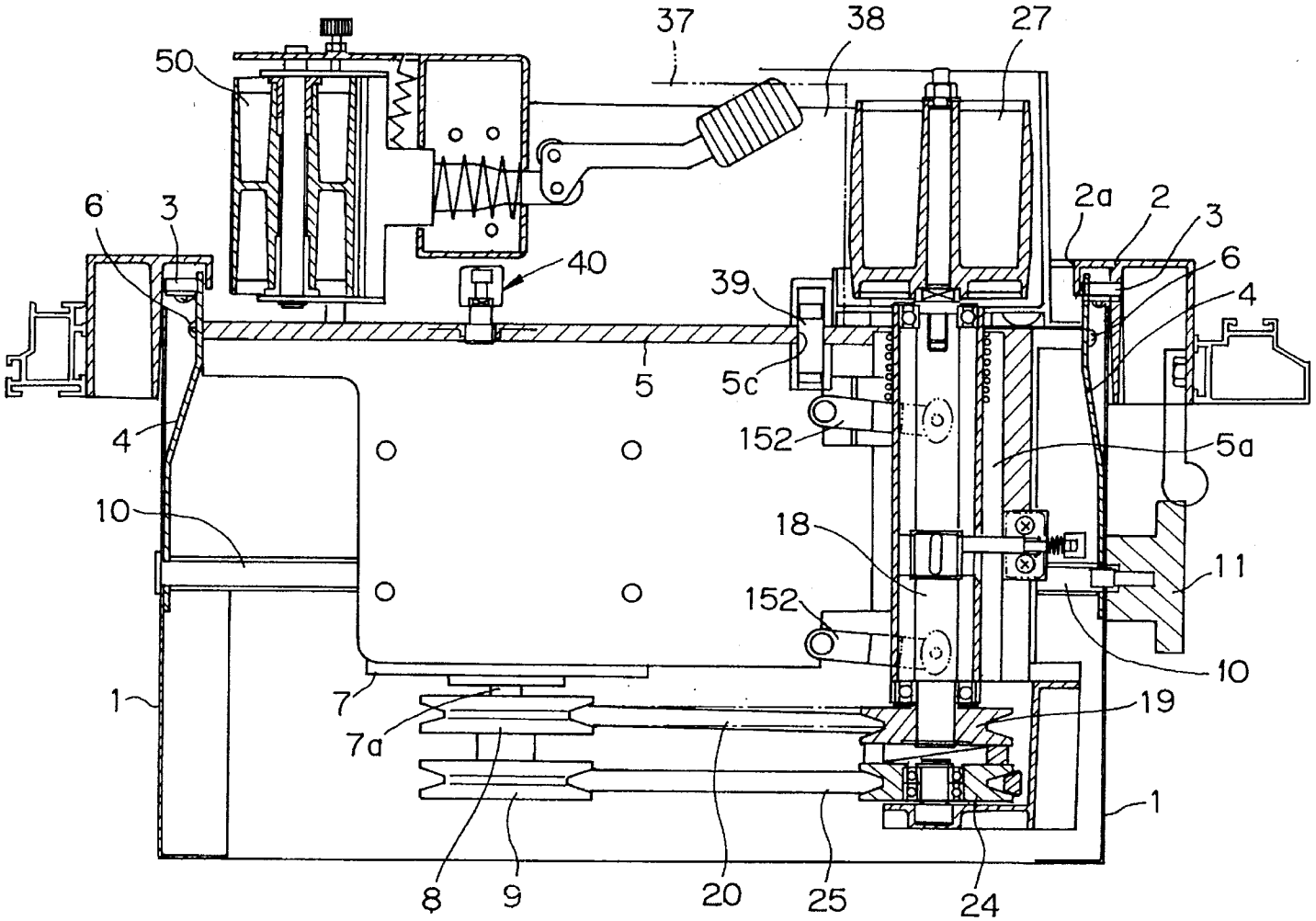
FIG. 14 is a frontal sectional view of a grinding machine with another drive shaft position switching mechanism.

In FIG. 14, the pin 39 fixed to the base 37 is inserted into the insertion hole 5c of the bracket 5, and the base 37 is fixed to the bracket 5 by the base fastening mechanism 40. Thereafter, the belt sander 38 is set between the drive and driven rollers 27, 50, and the belt sander 38 is tensioned by moving the driven roller 50 in the left direction as viewed in FIG. 14. Further, after the tensioning action of the belt sander 38, the belt cover 53 is fixed to the bracket 5. Then, the motor 7 is driven to rotate the pulleys 8, 9 through the motor shaft 7a. In accordance with the rotation of the pulleys 8, 9 the pulleys 19, 24 are rotated through the belt 20, 25. The rotation of the pulley 19 causes the drive shaft 18 to rotate, and the drive roller 27 is also rotated. The rotation of the drive roller 27 causes the belt sander 38 to rum between the drive roller 27 and the driven roller 50. On the other hand, due to the fact that the outer diameter of the pulley 19 is somewhat different from that of the pulley 24, the rotational speed (rpm) of the former is somewhat different form that of the latter. Therefore, in FIG. 16, the contact position between the contact portion 19a of the pulley 19 and the cam 24a of the pulley 24 is varied in accordance with the rotation of the pulleys 19, 24 so that the pulley 19 is moved up and down (in FIG. 16). In accordance with this movement, the drive roller 27 is also moved up and down through the drive shaft 18. As a result, one side of the belt sander 38 is moved up and down to thereby enhance the polishing action. Under this condition, the workpiece is brought into contact with the belt sander 38 by the guidance of the guide plate 57 (FIG. 15) to thereby perform the grinding action with the belt sander 38.

Also, in accordance with the up-and-down movement of the drive roller 27, the hollow member 13 is also moved up and down. Accordingly, by limiting the up-and-down movement of the hollow member 13, it is possible to limit the up-and-down movement of the drive roller 27.

Next, the case where the up-and-down movement of the drive roller 27 is not desired will be explained.

Figure 18:
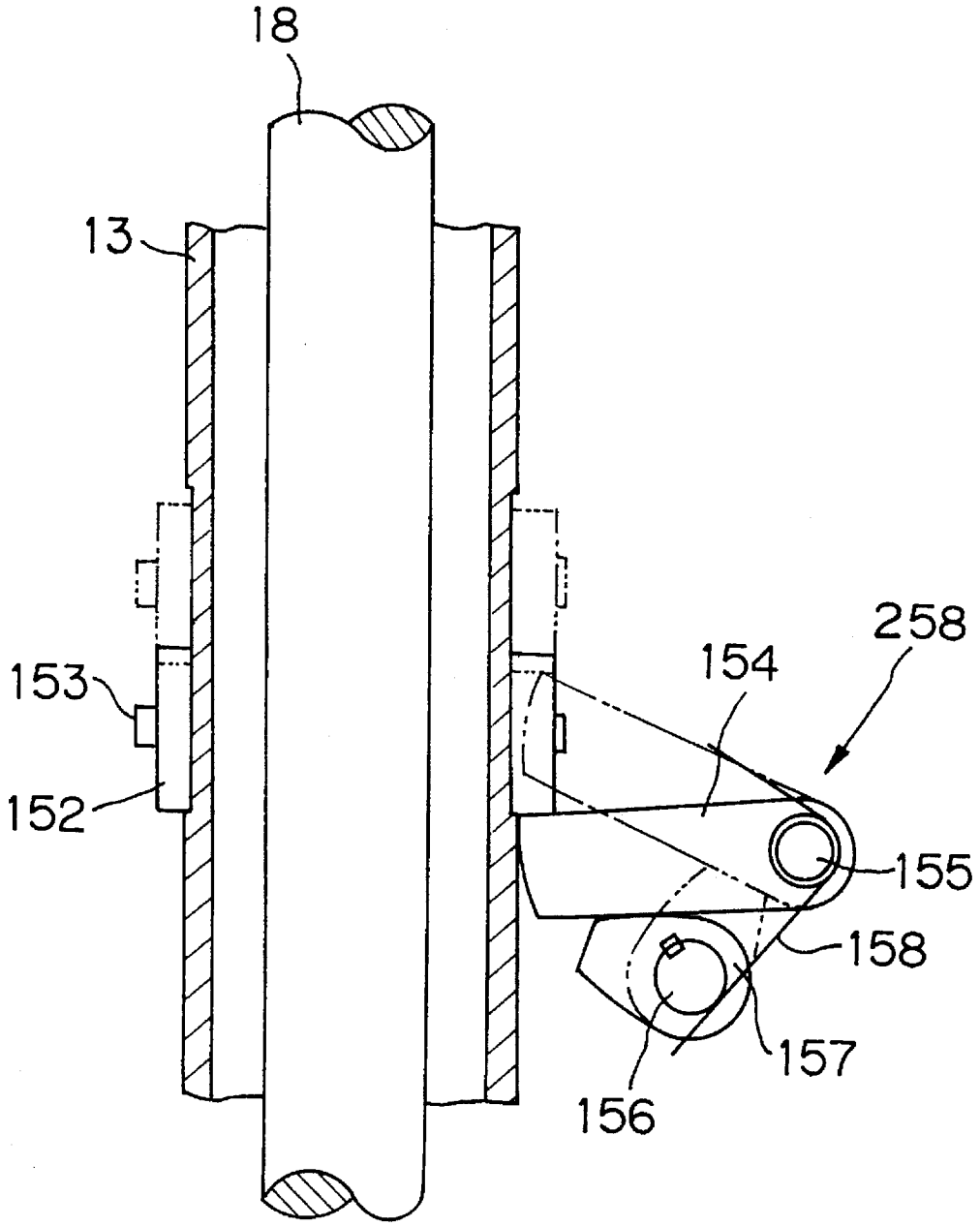
FIG. 18 is a partial longitudinal view of a part of drive shaft position switching mechanism.

FIG. 18 shows a state where the hollow member 1 may be moved up and down. Namely, the hollow member 13 may be moved upwardly. With this state, the handle 62 is operated so that the shafts 156 is rotated. The rotation of the shaft 156 causes the cam 157 to rotate together with the shaft 156, so that the nail member 154 rotates in the clockwise direction as viewed in FIG. 18 against the spring force of the spring 158. The nail member 154 pushes up the link 154 thereby to move the hollow member 13 upwardly. In accordance with the upward movement of the hollow member 13, the drive shaft 28 with the drive roller 27 is moved upward. Therefore, the contact portion 19a of the pulley 19 is separated among from the cam 24a of the pulley 24. Accordingly, even if the pulleys 19, 24 rotate, the pulley 19 will not be moved up and down in FIG. 16, and hence the drive roller 27 will not be moved up and down. In this case, since the contact portion 19a and the cam 24a are separated from each other, a friction noise due to the contact between the contact portion 19a and the cam 24a will not be generated. The operation is noiseless.

In this manner, since the movement in the axial direction of the hollow member 13 is performed by the link 152, even if an force is imparted to the drive shaft 18 in a direction perpendicular to the axial direction thereof through the belt 20 wound around the pulley 19 and the belt sander 38 provided on the drive roller 27, the hollow member 13 can be smoothly moved in its axial direction.

Figure 19:
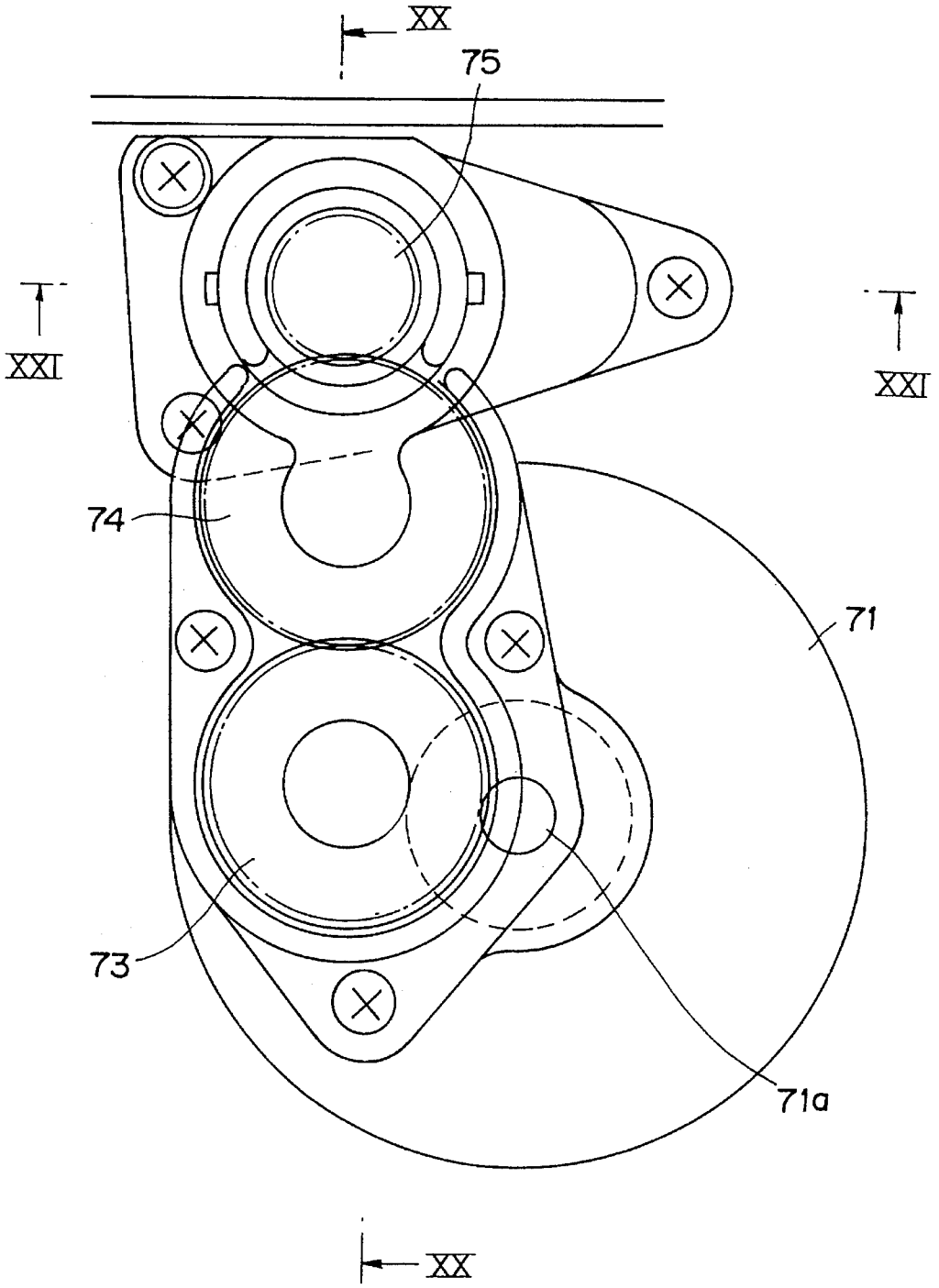
FIG. 19 is a frontal view showing another embodiment of a drive shaft moving mechanism for moving the drive shaft of the grinding machine in its axial direction.
Figure 20:
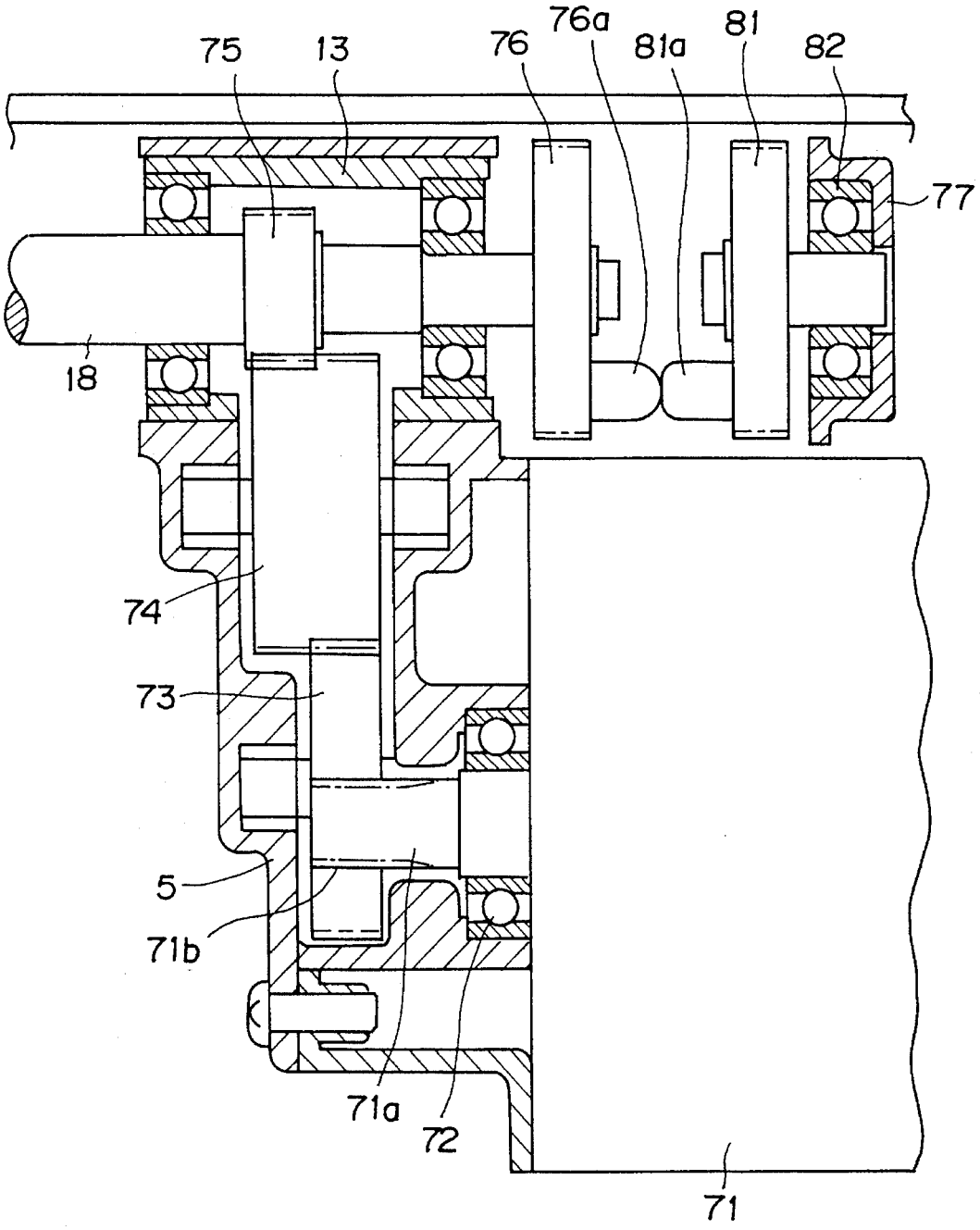
FIG. 20 is a sectional view taken along the line XX—XX in FIG. 19.
Figure 21:
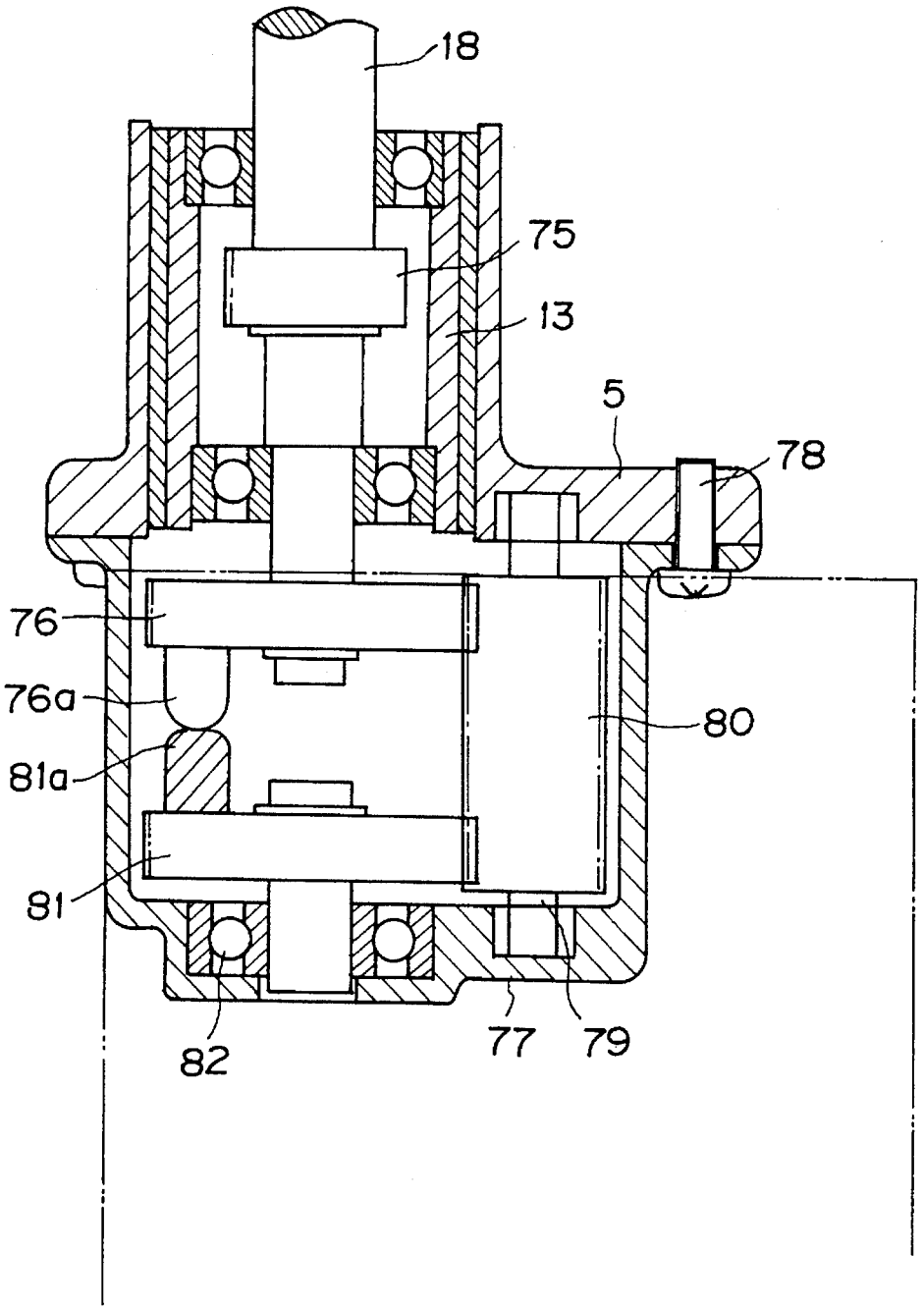
FIG. 21 is a sectional view taken along the line XXI—XXI.

FIG. 19 to 21 show another embodiment of a driving mechanism for moving the drive shaft 18 in its axial direction.

A motor 71 has a motor shaft 71a which is provided with a gear portion 71b. The motor shaft 71a is supported by a bearing 72. The gear portion 71b of the motor shaft 71a is engaged with a first gear 73 held by the bracket 5, and a second gear 74 is engaged with the first gear 73. The second gear 74 is meshed with a third gear 75 fixed to the drive shaft 18. The drive shaft 18 has, at its distal end (the right end as viewed in FIG. 20), a fourth gear 76.

In FIG. 21, to the bracket 5 is fixed a gear holding frame 77 through screw 78, and a shaft 79 is provided between the gear holding member 77 and the bracket 5. The shaft 79 holds rotatably the fifth gear 80 (common gear) which is engaged with the fourth 76 and a sixth gear 81. The sixth gear 81 is supported on the gear holding frame 77 via a bearing 82, and the number of teeth of the sixth gear 81 is a little larger than that of teeth of the fourth gear 76. The sixth gear 81 has, on its upper surface, a cam 81a which abuts against a contact portion 76a formed on the lower surface of the fourth gear 76. At this time, in accordance with the rotation of the drive shaft 18, the fourth gear 76 is rotated, so that the sixth gear 81 is also rotated through the fifth common gear 80. Since the numbers of teeth of the fourth and sixth gears 76, 81 are somewhat different from each other, there is a phase difference between the fourth and sixth gears 76, 81. Therefore, the contact portion 76a slides on the surface of the cam 81a during the rotation of the two gears 76, 81 to move the drive shaft 18 up and down. Therefore the drive roller 27 (FIG. 14) is moved up and down. In this case, the drive shaft 18 is restricted in its axial direction by the drive shaft position switching mechanism 258.

According to this invention, the switching operation between an operation for moving the drive shaft 18 in its axial direction and an operation for fixing the drive shaft in its axial direction can be easily performed. Further, the hollow member 13 is smoothly moved by the drive shaft position switching mechanism.

What is claimed is:

1. A grinding machine comprising:

a) a driving shaft;

b) a sander provided on the drive shaft for grinding a workpiece;

c) a drive shaft driving mechanism for rotating the drive shaft;

d) a drive shaft moving mechanism including first and second rotational members which are rotated by the drive shaft driving mechanism at revolution numbers different from each other, cam means mounted to one of the first and second rotational members and an abutment member provided for the other one of the first and second rotational members;

e) a drive shaft support member disposed on an outer peripheral portion of the drive shaft for rotatably supporting the drive shaft to be movable together with the drive shaft in an axial direction thereof;

f) a link mechanism mounted to a bracket to be swingable so as to support the drive shaft support member; and g) a drive shaft position switching mechanism for moving the drive shaft support member selectively to a position at which the cam means of the drive shaft moving mechanism abuts against the abutment member and to a position at which the cam means of the drive shaft moving mechanism does not abut against the abutment member.

2. A grinding machine according to claim 1, wherein the driving mechanism, the drive shaft, the sander, and the drive shaft support member are supported on a bracket which is swingably supported by a housing of the grinding machine.

3. A grinding machine according to claim 2, wherein a bracket locating mechanism is provided for locating the bracket at a desired swing position.

4. A grinding machine according to claim 2, wherein the bracket locating mechanism comprises a hold plate swingably provided on a housing for holding the bracket and a handle connected to the hold plate for locating the hold plate at a desired swinging position.

5. A grinding machine according to claim 1, wherein the drive shaft support member comprises a hollow member for accommodating the drive shaft therein.

6. A grinding machine according to claim 1, wherein the drive shaft position switching mechanism comprises a hook engaged with the drive shaft support member in such a manner that the drive shaft support member is moved in the axial direction of the drive shaft when-the hook is rotated, and a hook rotating mechanism for rotating the hook so as to take selectably the two positions.

7. A grinding machine according to claim 6, wherein the hook rotating mechanism comprises a rotary shaft connected to the hook end a handle connected to the rotary shaft, the rotary shaft having a pair of flat portions which is engaged with a resilient plate member to restrict the rotation of the rotary shaft at the two positions.

8. A grinding machine according to claim 1, wherein the drive shaft position switching mechanism comprises a nail member which is engaged with the link so as to swing the link thereby to move the drive shaft in the axial direction thereof, and a cam for rotating the nail member.

9. A grinding machine according to claim 8, wherein the drive shaft position switching mechanism includes an elastic member for urging the nail member toward the cam.

10. A grinding machine according to claim 8, wherein the drive shaft position switching mechanism includes a shaft connected to a handle for holding the cam.

11. A grinding machine according to claim 1, wherein the drive shaft moving mechanism comprises a first pulley fixed to the drive shaft, a second pulley fixed to a bracket for supporting the drive shaft, a cam provided on one of the pulleys, and a contact portion for contacting the cam, provided on the other pulley, the two pulleys having somewhat different diameters from each other, respectively and rotated by the driving mechanism.

12. A grinding machine according to claim 1, wherein the driving mechanism includes two belts provided between two pulleys mounted on a motor shaft and the first and second pulleys, respectively.

13. A grinding machine according to claim 1, wherein the driving mechanism includes a gear train for transmitting rotation of a motor to the drive shaft, the drive shaft moving mechanism comprising a first gear provided on the drive shaft, a second gear provided on a bracket for supporting the drive shaft, a common gear engaged with both of the first and second gears, a cam provided on one of the first and second gears, a contact portion for contacting the cam, provided on the other of the first and second gears, the two first and second gears having different numbers of teeth, respectively.

14. A grinding machine which comprises a sander mounted to a drive shaft and adapted to grind a workpiece, a drive shaft driving mechanism for rotating the drive shaft and a drive shaft moving mechanism for moving the drive shaft in an axial direction thereof during a grinding working, the grinding machine further comprising:

a drive shaft support member disposed on an outer peripheral portion of the drive shaft for rotatably supporting the drive shaft to be movable together with the drive shaft in an axial direction thereof; and a link mechanism mounted to a bracket to be swingable so as to support thee drive shaft support member.

15. A grinding machine according to claim 14, wherein the driving mechanism, the drive shaft, the sander, and the drive shaft support member are supported on a bracket which is swingably supported by a housing of the grinding machine.

16. A grinding machine according to claim 15, wherein a bracket locating mechanism is provided for locating the bracket at a desired swinging position.

17. A grinding machine according to claim 15, wherein the bracket locating mechanism comprises a hold plate swingably provided on a housing for holding the bracket and a handle connected to the hold plate for locating the hold plate at a desired swinging position.

18. A grinding machine according to claim 14, wherein the drive shaft support member comprises a hollow member for accommodating the drive shaft therein.

* * * * *